US011879481B2

(12) United States Patent
Franz et al.

(10) Patent No.: US 11,879,481 B2
(45) Date of Patent: Jan. 23, 2024

(54) EXTERNAL TRAY HOSE WITH INTEGRATED PUMP

(71) Applicant: Hewlett Packard Enterprise Development LP, Houston, TX (US)

(72) Inventors: John P. Franz, Tomball, TX (US); Tahir Cader, Spokane Valley, WA (US)

(73) Assignee: Hewlett Packard Enterprise Development LP, Spring, TX (US)

( * ) Notice: Subject to any disclaimer, the term of this patent is extended or adjusted under 35 U.S.C. 154(b) by 0 days.

(21) Appl. No.: 17/698,840

(22) Filed: Mar. 18, 2022

(65) Prior Publication Data

US 2023/0296111 A1 Sep. 21, 2023

(51) Int. Cl.
*F04D 29/58* (2006.01)
*F04D 3/00* (2006.01)
(Continued)

(52) U.S. Cl.
CPC ..... *F04D 29/586* (2013.01); *F04D 3/00* (2013.01); *F04D 13/12* (2013.01); *F04D 15/0088* (2013.01); *F04D 29/528* (2013.01)

(58) Field of Classification Search
CPC ... F04D 9/04; F04D 13/12; F04D 3/00; F04D 25/0606; H02K 1/12; H05K 7/20709; H05K 7/20781
See application file for complete search history.

(56) References Cited

U.S. PATENT DOCUMENTS 4,714,558 A 12/1987 Barbee et al.
5,419,594 A 5/1995 Nelms
(Continued)

FOREIGN PATENT DOCUMENTS

GB 2495547 A * 4/2013 ..... H02K 21/185
GB 2566689 A 3/2019
(Continued)

OTHER PUBLICATIONS

Sidewindercomputers, "Bitspower Shining Silver Rotary 90 Fitting # BP-LRII—G 1/4 Threads," 2019, 1-Page.

*Primary Examiner* — David E Sosnowski
*Assistant Examiner* — Jackson N Gillenwaters
(74) *Attorney, Agent, or Firm* — Park, Vaughan, Fleming & Dowler LLP

(57) ABSTRACT

One aspect described in this application provides an apparatus that includes an external tray hose with an integrated booster pump for cooling a computing device. The booster pump can boost fluid flow and fluid pressure of coolant fluid pumped toward the computing device on a server tray. The booster pump includes a stator mounted around a booster pump housing with a bore. The stator includes one or more C-shaped lamination stacks for supporting coil windings. Energized coil windings generate a varying magnetic field for rotating an impeller within a housing bore to pump fluid along the housing bore of the booster pump. The apparatus includes a monitor module to monitor a set of sensors to obtain information about one or more of fluid temperature, fluid pressure, and device temperature; and a control module to adjust performance of the booster pump based on the information obtained from the set of sensors.

14 Claims, 9 Drawing Sheets

(51) Int. Cl.

| | |
|---|---|
| ***F04D 29/52*** | (2006.01) |
| ***F04D 13/12*** | (2006.01) |
| ***F04D 15/00*** | (2006.01) |

(56) References Cited

U.S. PATENT DOCUMENTS

| | | | | |
|---|---|---|---|---|
| 6,439,620 | B1 | 8/2002 | Guest | |
| 6,962,625 | B2 | 11/2005 | Bredesen | |
| 6,988,518 | B2 | 1/2006 | Rackers | |
| 6,989,990 | B2 | 1/2006 | Malone et al. | |
| 7,020,997 | B1 | 4/2006 | Thomas | |
| 7,354,307 | B2 | 4/2008 | Chee et al. | |
| 7,635,010 | B1 | 12/2009 | Manno et al. | |
| 7,811,278 | B2 | 10/2010 | Knipple et al. | |
| 10,111,364 | B2 | 10/2018 | Arvelo et al. | |
| 10,143,111 | B2 * | 11/2018 | Slaby | F04B 51/00 |
| 2013/0312846 | A1 | 11/2013 | Eriksen et al. | |
| 2014/0132106 | A1 * | 5/2014 | Horst | H02K 21/185 310/216.001 |
| 2015/0135588 | A1 | 5/2015 | Gergek | |
| 2017/0064911 | A1 | 3/2017 | Trujillo | |
| 2020/0163257 | A1 * | 5/2020 | Franz | H05K 7/20836 |
| 2020/0182251 | A1 * | 6/2020 | Cader | F04D 29/406 |

FOREIGN PATENT DOCUMENTS

| | | | |
|---|---|---|---|
| WO | 2019/053439 | A2 | 3/2019 |
| WO | 2019/071059 | A1 | 4/2019 |

* cited by examiner (b)

(a)

EXTERNAL TRAY HOSE WITH INTEGRATED PUMP

RELATED APPLICATIONS

This application is related to U.S. application Ser. No. 16/215,498, entitled "AXIAL FLOW PUMP WITH REDUCED HEIGHT DIMENSION," by inventors John P. Franz and Tahir Cader, filed 10 Dec. 2018; and is further related to U.S. application Ser. No. 16/579,254, entitled "SWIVEL-CAPABLE LOW-PRESSURE-DROP HOSE BARB FITTINGS," by inventors John P. Franz and Tahir Cader, filed 23 Sep. 2019, which are herein incorporated by reference in their entirety.

BACKGROUND

This disclosure is generally related to the field of cooling systems for processing units in a computer system. During operation, the processing units generate heat and when the generated heat exceeds a manufacturer specified normal temperature range, the operation of the computing device (or processing unit) may be impacted. Therefore, to maintain the temperature of the computing device within the normal temperature range, different types of cooling systems are provided to cool the computing device. Some computer systems include a coolant distribution unit (CDU) to deliver coolant fluid to the liquid-cooled computing device, e.g., a central processing unit (CPU), to cool down the computing device, thereby facilitating normal operation of the computing device.

BRIEF DESCRIPTION OF THE FIGURES

In the figures, like reference numerals refer to the same figure elements.

DETAILED DESCRIPTION

Figure 1A:
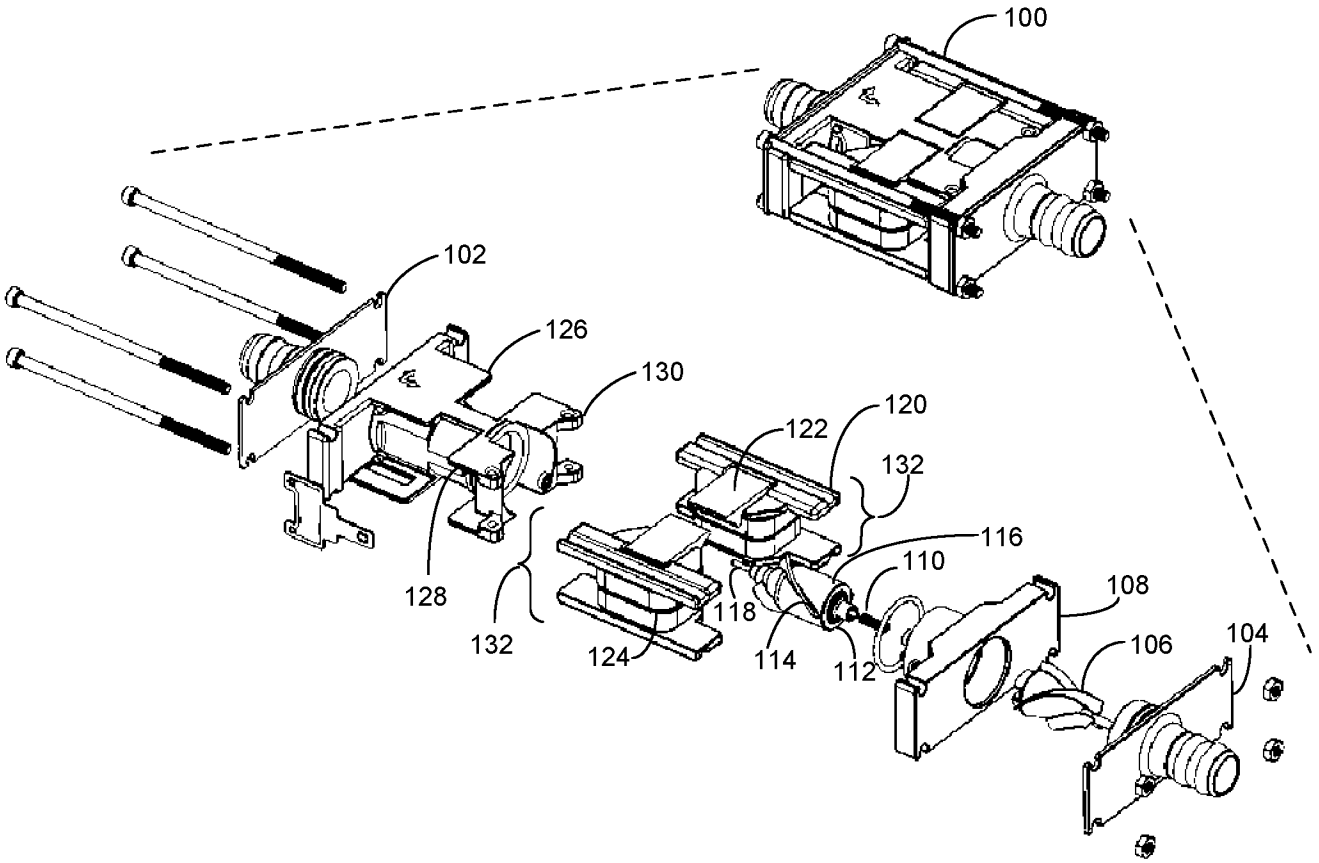
FIG. 1A shows an expanded view of an exemplary microaxial booster pump, according to one aspect of the present application.

The following description is presented to enable any person skilled in the art to make and use the examples and is provided in the context of a particular application and its requirements. Various modifications to the disclosed examples will be readily apparent to those skilled in the art, and the general principles defined herein may be applied to other examples and applications without departing from the spirit and scope of the present disclosure. Thus, the scope of the present disclosure is not limited to the examples shown but is to be accorded the widest scope consistent with the principles and features disclosed herein.

With the rapid advancement in computer technology and growth in computationally intensive applications, e.g., artificial intelligence (AI) based applications, there has been an increase in the deployment of a mixture of central processing units (CPUs) and Graphics Processing Units (GPUs) in a computer system. GPUs facilitate the computationally intensive workloads involving parallel computing or accelerated computing.

Further, there has been a rapid increase in the amount of power consumed by the CPUs and the GPUs. For example, in some computing systems or servers the power consumption for CPUs can exceed approximately 500 W whereas for GPUs the power consumption can exceed approximately 700 W. In addition, since the high bandwidth memory (HBM) systems are co-packaged with the CPU and the GPU die, the amount of heat generated can result in temperatures approaching 50 degrees Celsius and can easily exceed the manufacturers' specified device-case temperatures (that are often below 60 degrees Celsius). To prevent the damage of computing devices at temperatures approaching or exceeding the device-case temperatures several cooling mechanisms are applied, e.g., one or more air-cooled mechanisms and one or more liquid-cooled mechanisms. Several device manufacturers often support liquid-cooled cold plate solutions for their devices. One of the drawbacks with cold plate technologies is that they are generally fin-based and evolve slowly when compared to the growth in computer technology. Therefore, cooling solution vendors improve the cooling effect induced on the computing devices by forcing more liquid, i.e., by increasing the liquid flow rates, through the cold plate to satisfy the device specifications.

Coolant distribution units (CDUs) are used to deliver coolant fluid to liquid-cooled servers and traditionally they can support four cabinets; and the cabinet to CDU ratio is typically 4:1 (one cabinet can be equivalent to two server racks). Increasing the liquid flow rates for a computing device can result in an increase in the overall flow rates for servers, e.g., servers deployed for high performance computing (HPC) systems, which can reduce the cabinet to CDU ratio down to 3:1 or further to 2:1. A lower cabinet to CDU ratio indicates that one CDU can support a fewer number of cabinets and additional CDUs may have to be deployed which can increase the cost of liquid-cooled solutions.

Further, deployment of additional CDUs can result in more floor space usage, an increase in warranty costs for the customer, an increase in maintenance costs, etc.

Furthermore, with the transition to increased heterogeneous computing, in which CPU and GPU servers can be mixed in a single chassis, the fluid flow rates, and fluid pressures can drop differently on different servers. Existing liquid-cooled solutions can be poorly suited for such heterogeneous computing systems. This is because the CDU might unevenly distribute the fluid flow across the different servers. For example, a blade with high impedance can result in higher pressure drops and fluid flow rates when compared to other servers in a server chassis.

Some of the aspects in this application solve the above-mentioned problems by applying an apparatus and mechanism to increase the fluid flow rates without reducing the cabinet to CDU ratio. A small microaxial booster pump can be integrated into an external hose assembly that connects to each tray to a rack fluid distribution system. The microaxial booster pump can boost the flow and pressure on certain trays that desire performance improvement. Further, a hose-integrated pump can be easily serviced and replaced without the need to perform a time-consuming service event with the removal of the server from the cabinet. The microaxial booster pump can be optionally mounted on a server tray. Due to its small size, the microaxial booster pump occupies less space and can be deployed in a number of space constrained applications. Both the implementations, i.e., a booster pump integrated into the external tray hose and the booster pump mounted within the server tray metal sheet volume, can boost the fluid flow rate and fluid pressure on certain trays that desire enhanced performance. The microaxial booster pump can allow the mixing of different trays with different pressure drops (or impedances) in a given server chassis, and at a rack-scale. The system can hence even-out the fluid flow distribution across the different servers in the given chassis. In other words, the system can ensure a certain fluid flow rate for a server so that the fluid flow rate matches with fluid flow rates associated with other servers in the server chassis.

The terms "liquid" and "fluid" are used interchangeably in this application.

The term "server" refers to a high-density server computer whose design has been optimized to reduce physical size and power consumption.

The terms "rack" or "server rack" refer to a cabinet like structure that can house IT equipment.

The terms "chassis" or "server chassis" can refer to a metal frame within which one or more servers can be assembled.

Microaxial Booster Pump

FIG. 1A shows an expanded view of an exemplary microaxial booster pump, according to one aspect of the present application. Note that the microaxial booster pump described below is for illustration purposes only. Different types of microaxial pumps can be used in the present inventive system. A microaxial booster pump 100 as illustrated in FIG. 1A can be connected to a cooling loop via hose barb fittings. Microaxial booster pump 100 can include an inlet barb fitting 102 which can be attached to a hose for allowing coolant fluid to flow towards the pump. Microaxial pump 100 can also include an outlet barb fitting 104 which can be attached to another hose to allow coolant fluid to flow out of the pump. Inlet barb fitting 102 and outlet barb fitting 104 can provide enlarged coolant flow passages, allow use of hoses with increased diameters, reduce pressure drops and erosion (with use of plastic hose barb fittings), and facilitate greater efficiency and longevity in liquid-cooling systems. Microaxial booster pump 100 can further include an outlet barb insert 106, a bore 128, an inlet housing structure 130, and an outlet housing structure 108. Inlet housing structure 130 and outlet housing structure 108 when connected together can form a fluid sealed housing with bore 128. Microaxial booster pump 100 can further include a biasing spring 110, a cap 112, a magnet (internal) 114, an impeller 116, a shaft 118, a coil frame 120, laminations 122, copper windings 124, a stator 132, and a printed circuit assembly (PCA) 126. The motor control circuit can be positioned on PCA 126 which can be mounted on an inlet or outlet part of pump 100. PCA 126 may be connected to an overall control system in a number of ways based on the use case or application.

Impeller 116 and magnet 114 may be separate components fitted together so that they are rotationally fixed with respect to each other about a longitudinal axis along shaft 118. Impeller 116 can be mounted on shaft 118 for enhanced support and balancing, for higher speed performance and longer life with less vibration. Impeller 116 can optionally be of a plastic or metallic material. Stator 132 can be mounted around the pump housing and can include a coil arrangement, i.e., coil windings 124, that can be adapted to impart varying magnetic field through the housing (inlet housing structure 130 and outlet housing structure 108, for example) to drive magnet 114 about the longitudinal axis. Stator 132 can include laminations 122 which can have C-shaped stacks, e.g., two stacks, and each lamination stack may have a coil winding 124 in coil frame 120. Such an arrangement can define two poles for each lamination stack, with one at each end of the C-shaped section.

Coil winding 124 may be wound around a middle section of the C-shaped lamination stack. The pole teeth of each lamination stack may be positioned at spaced or adjacent sectors of the bore and provide magnetic poles of opposite sense with respect to one another. At least four magnetic poles may thereby be arranged around the bore. Nevertheless, the bulk of each lamination stack and their associated coil windings 124 may be positioned on either side of the bore so that the housing around the bore accounts for most of a height dimension of the pump. This arrangement allows the flow cross section of the pump to be increased while the height dimension of the pump.

Figure 1B:
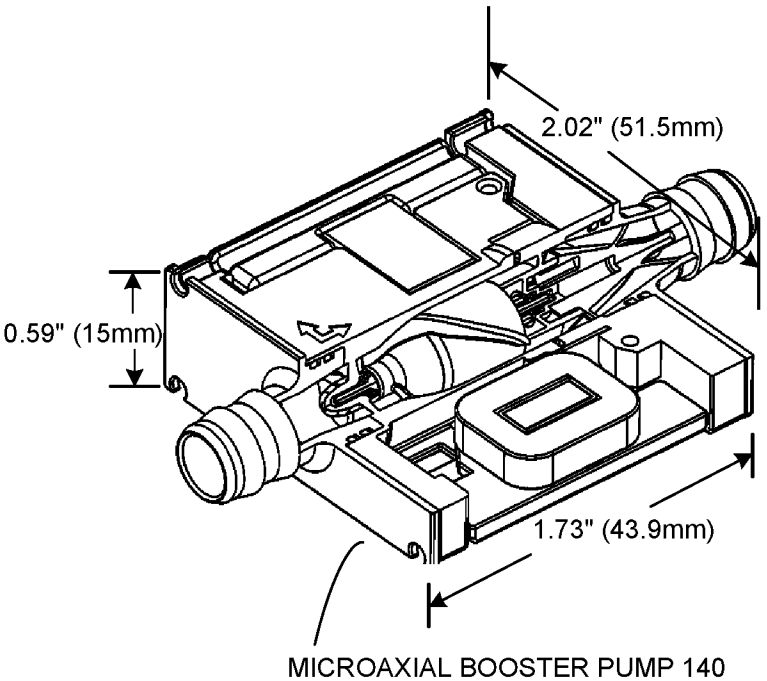
FIG. 1B shows approximate dimensions of an exemplary microaxial booster pump, according to one aspect of the present application.
Figure 1B:
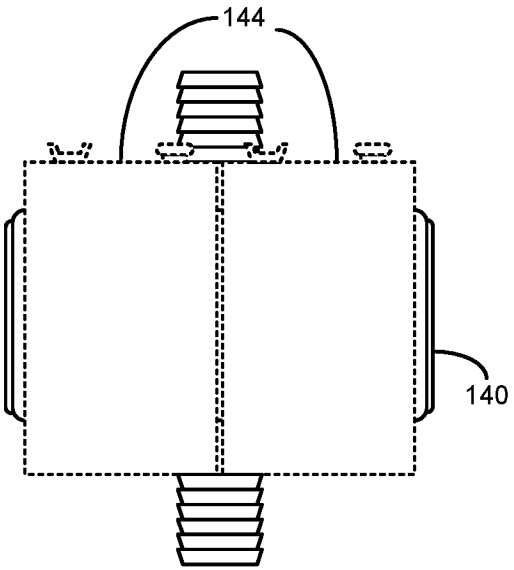
Figure 2:
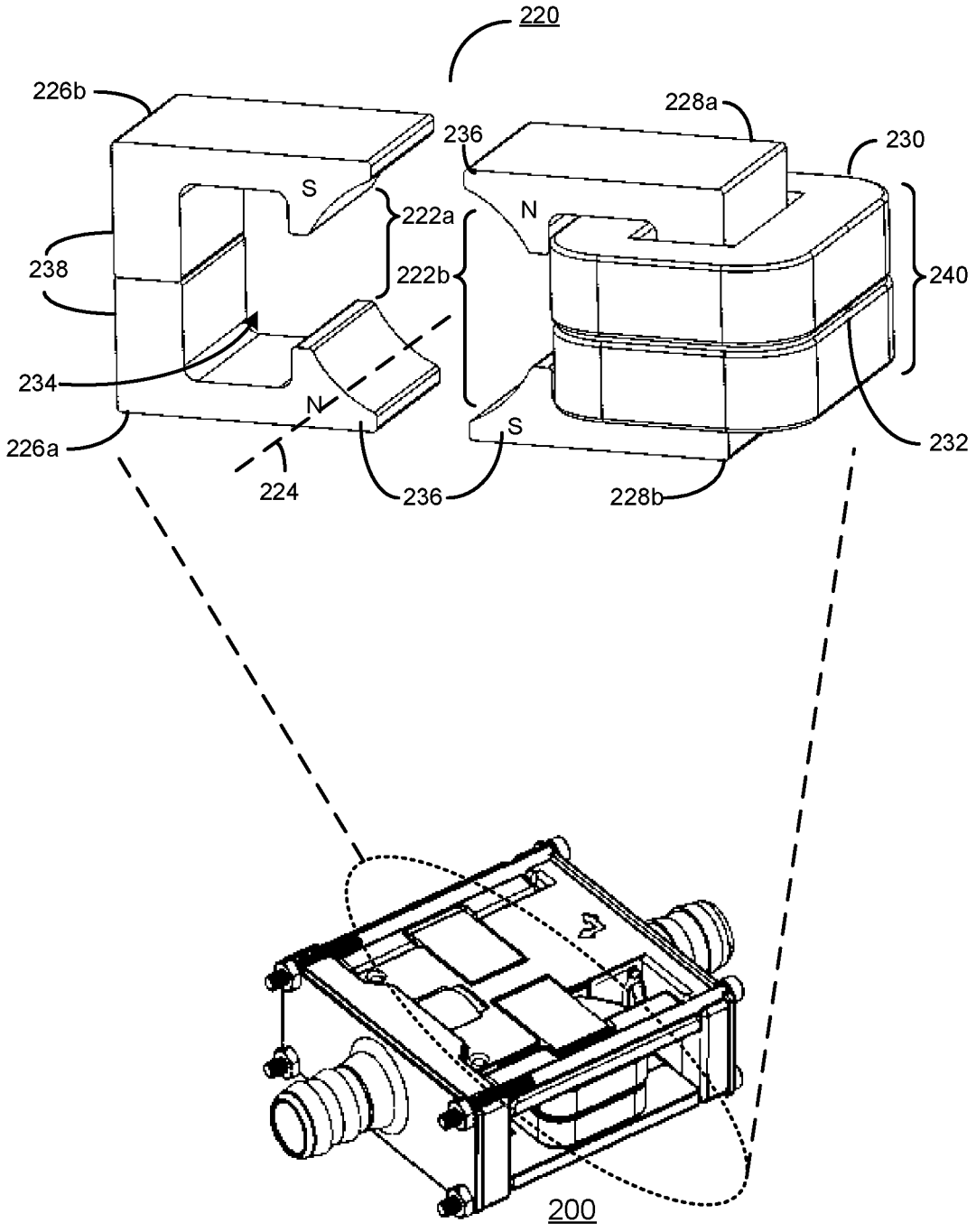
FIG. 2 illustrates a perspective view of a lamination stack of the microaxial pump shown in FIG. 1A, according to one aspect of the present application.

Furthermore, coil windings 124 can be elongated and the axis of coil windings 124 can define axis planes parallel to a longitudinal axis (please refer to item 224 shown in FIG. 2). The elongate nature of coil windings 124 can facilitate a larger magnetic linkage and the power of pump can be increased without increasing the height of the pump. FIG. 1B shows approximate dimensions of an exemplary microaxial booster pump, according to one aspect of the present application. In the example shown in FIG. 1B, FIG. 1B (a) presents a top view of microaxial booster pump 140 compared with the size of two 9V batteries 144 placed side-by-side. FIG. 1B (b) shows a perspective view of microaxial booster pump 140 with approximate dimensions. In this example, microaxial booster pump 140 can be approximately 15 mm in height, 44 mm in length (along the direction of fluid flow), and 52 mm in width. The compact nature of the microaxial booster pump can facilitate its use in a number of different space-constrained applications, thereby increasing the number of use cases or applications for the microaxial booster pump. Note that the dimensions presented in FIG. 1B are for illustration purposes only. Microaxial pumps of other dimensions can also be used.

FIG. 2 illustrates a perspective view of a lamination stack of the microaxial booster pump shown in FIG. 1A, according to one aspect of the present application. As illustrated in FIG. 2, a microaxial booster pump 200 can include a stator 220. In one embodiment, stator 220 can be outside a housing structure and include a coil arrangement to produce a variable magnetic field through the bore to interact with a magnet. Further, the variable magnetic field can drive the magnet and the impeller to rotate about a longitudinal axis 224, which in turn can drive the fluid along the housing bore (see bore 128 shown in FIG. 1A). Stator 220 can include two lamination stacks, i.e., 222*a* and 222*b*, that can be C-shaped and perpendicular to longitudinal axis 224 of microaxial booster pump 200. Longitudinal axis 224 can also represent a rotation axis of the magnet sleeve impeller assembly (see impeller 116 shown in FIG. 1A). Lamination stacks 222*a* and 222*b* can define the stator of a substantially cuboid form, of which the width can be greater than the height. Each lamination stack (222*a* and 222*b*) can further include two parts 226*a*-226*b* and 228*a*-228*b*. Each plate of each lamination stack part (226*a*-226*b*, 228*a*-228*b*) can be substantially identical, resulting in substantially identical lamination stack parts (226*a*-226*b*, 228*a*-228*b*) and substantially identical lamination stacks 222*a*-222*b*. Lamination stack parts (226*a*-226*b*, 228*a*-228*b*) can be fitted together with mating projections 238 around which coil windings 232 are placed. Such an arrangement can direct coil generated magnetic flux to pole tooth region 236.

When lamination stack parts (226*a*-226*b*, 228*a*-228*b*) are assembled as shown in FIG. 2, they can support a coil arrangement 230 which can include one or more coil windings 232. Each coil winding 232 can be optionally mounted on a bobbin (not shown in FIG. 2) and/or wrapped to retain the windings in position. Coil windings on lamination stack 222*a* are not shown in FIG. 2 to illustrate a cutout 234 in the lamination plate that can serve to receive and accommodate windings in each lamination stack part (226*a*-226*b*, 228*a*-228*b*). Coil winding 232 may be wound around a waist or middle section of the C-shaped lamination stack (222*a* and 222*b*). During operation, electric current can energize each coil winding and the energized coil winding can generate a rotating magnetic field in respective laminations stack part (226*a*-226*b*, 228*a*-228*b*) which may in turn create a magnetic pole at tooth region 236 of each lamination stack. In general, pole tooth region 236 can be configured in such a way that the generated magnetic flux can be concentrated toward the cylindrical permanent magnet of the rotor of the pump. In the example illustrated in FIG. 2, tooth region 236 can have a concave surface facing the rotor, thereby increasing the efficiency of the pump. The rotating magnetic field, which can be generated by alternating current in the coils, can cause the cylindrical permanent magnet to rotate around longitudinal axis 224. The impeller, which is fixed to the permanent magnet, can be rotated and drive fluid along the housing bore.

A coil region 240 of a lamination stack part (226*a*-226*b*, 228*a*-228*b*) can be the area of the lamination perpendicular to longitudinal axis 224. Coil region 240 can be occupied by coil winding 232 in its passage through and around the lamination.

Further, projections 238 of each lamination stack part (226*a*-226*b*, 228*a*-228*b*) can penetrate each coil winding 232 and link the magnetic flux generated by coils 232 with tooth regions 236. Note that projections 238 illustrated in FIG. 2 has a cuboid shape. Other shapes, such as cylindrical, or a shape with an oval cross-section, can also be used. The polarity (N/S) of each pole tooth 236 can be alternated by alternating the direction of current in each winding 232. The magnetic field that coils 232 generate in lamination stack 220 may interact with the magnetic field of a permanent magnet sleeve to drive the magnet sleeve and connected impeller sleeves. As a result, the impeller can rotate about longitudinal axis 224 and thereby drive fluid in the bore of the impeller sleeves from fluid inlet 102 to fluid outlet 104 (shown in FIG. 1A) of the microaxial booster pump. The magnetic poles of one lamination stack 222*a* can be arranged opposite corresponding magnetic poles of lamination stack 222*b*. Each magnetic circuit can be driven by respective coils 232 around the waist of C-shaped lamination stacks (222*a* and 222*b*) that are defined by projections 238.

Control of the alternating current in the coils 232 may be affected through a control board (PCA) 234 (PCA 126 shown in FIG. 1A). The speed of rotation can be adjusted by changing the voltage applied across coils 232 and the frequency of alternation. For example, the microaxial booster pump can be configured to operate with a pressure of 2 pounds per square inch differential (psid) and with rotation speeds in the range 20 to 30000 rpm. When pulse width modulation (PWM) is used to control the pump, the PWM frequency is typically above 50 Khz to ensure that a sufficient number of AC cycles take place within one commutation cycle in order for the current to be regulated without the current reaching a steady (DC) state. In addition, the DC voltage supply to the pump can have a range of 0-12V. Other voltage ranges and frequencies can also be used. Parameters which drive the control may be determined in different ways depending on the application, e.g., fluid temperature, power consumed and/or apparatus (computing device) generated heat that is cooled by the coolant pumped from microaxial booster pump.

Some of the aspects of this application address one or more use cases of the microaxial pump in a booster fashion to address the disparities in server or compute tray pressure drops. Typically, a cabinet or a rack can include one or more servers (or compute trays); and one or more cabinets can represent a cluster. In a deployed cluster, the CDU may have to satisfy the servers with the highest pressure drop in a 4-cabinet cluster that the CDU is supporting, i.e., a 4:1 cabinet to CDU ratio. When the CDU encounters an increase in pressure drop, its ability to provide more coolant flow decreases towards the computing device being cooled, thereby reducing the number of cabinets that the CDU can support. Typically, the highest pressure-drop servers represent a small percentage of the servers deployed in a given cabinet or cluster. When a CDU can support a fewer number of cabinets, e.g., 2:1 cabinet to CDU ratio instead of 4:1, more CDUs may have to be deployed to support the given number of cabinets, which can increase the costs, and may also result in occupying more floor space, increased maintenance, and increased warranty costs for the customer, etc.

Current systems are designed to use treated water as the coolant. A number of instances of biological growth for systems using treated water is forcing the transition to a propylene glycol/water-based (PGW-based) chemistry to prevent biological growth in the system while providing freeze protection during shipping. The change to a PGW mixture incurs a double impact on the cooling system. First, the fluid has a higher viscosity which reduces the flow output of the CDU. Second, the poorer thermophysical properties of the PGW (relative to treated water) have a negative impact on thermal performance by reducing heat transfer, which forces a higher flow rate for the trays to achieve the desired thermal performance. In one aspect of this application, the increase in performance provided by the microaxial booster pump can allow systems to be converted from treated water-based to PGW-based without compromising the cooling performance, With the progression to more heterogeneous computing solutions, the current systems encounter additional challenges. For example, recent developments in computer technology and the demand for fast computing has resulted in deployment of servers that deploy a combination of high-power CPUs, GPUs, Application Specific Integrated Circuits (ASICs), and switch chips. Some of these servers may include a high-density design with high power consumption which can result in a high impedance and may demand higher flow rates of the cooling fluid. The pressure drop across such high impedance servers can be about one-and-a-half times (or 1.5 times) the pressure drop of the bulk of the servers in a cluster. Without flow control at the individual server level, the CDUs are forced to satisfy the worst-case server flow, which means that the bulk of the servers in the cluster will be overprovisioned. Such uneven distribution of fluid flow can result in improper cooling of the computing devices.

Often, the above-mentioned problems are addressed by deploying more or larger CDUs, greater flow rates, and/or lower coolant temperatures. With regards to the IT rack to CDU ratio, the current systems may either alter the ratio of IT racks to each CDU by deploying fewer IT racks per CDU or add additional CDUs for a given number of racks. In the case of mismatched servers, a common solution is to raise the impedance of the available servers to match the worst-case server impedance in a chassis. For example, when a chassis includes a mixture of mismatched servers, i.e., CPU and GPU servers, some of the CPU servers may be removed and replaced with dummy servers to match with the impedance of the high impedance GPU servers. This can result in inefficient use of server slots and an increase in the cost of the IT equipment.

In other words, different trays in a server rack can have varying pressure drops and flow targets that can be difficult for row level CDUs to accommodate without egregious waste, i.e., satisfying the worst-case tray (even for a single tray in a chassis), while simultaneously overprovisioning trays whose performance criteria are already satisfied. Adding booster pumps internal to the server-tray sheet-metal volume (the space within the metal enclosure of a server tray) can be difficult and unattractive due to the lack of space and the size constraints of the existing pumps. Further, in the event of a failure, the repairing and/or replacing time can interfere with the services provides by the IT equipment.

Some of the aspects described in this application address the problems associated with pressure drops across high impedance servers, by integrating a small pump within an external hose assembly that connects each server tray to the rack fluid distribution system. Therefore, deploying a microaxial booster pump for each of the high pressure drop servers or server trays can boost the flow and pressure on those trays that desire the additional performance. In other words, by using such microaxial pumps which are positioned along the coolant supply line to individual servers or trays, the system can facilitate much finer-granularity control of the supply of cooling capacity on a per-server or per-tray basis. Further, to simplify deployment of the booster pump, one aspect of this application may incorporate the pump into a hot-swappable tube with either self-sealing fluid quick disconnects on each end; a valved connection; or a mechanism that can reduce or eliminate fluid loss during a servicing event. This configuration allows for easy access to the pumps and hence lowers maintenance costs. Furthermore, placing the microaxial booster pump on an external hose can preserve space in the server tray and can reduce the risk of a leaky pump within the server tray.

In addition, the use of in-line booster pumps can facilitate mixing of server trays with different pressure drops (or impedances) in a given chassis and at the rack-scale. Therefore, the deployment of microaxial booster pumps can satisfy the increasing demand of customers for a transition to heterogeneous computing that includes a combination of CPU and GPU servers in a server chassis.

In one aspect, the microaxial booster pump can serve as a booster pump to a CDU pump. Furthermore, due to their small size, e.g., approximately the size of two 9V batteries placed side-by-side, the microaxial booster pumps can have a wide variety of space constrained applications.

Figure 3A:
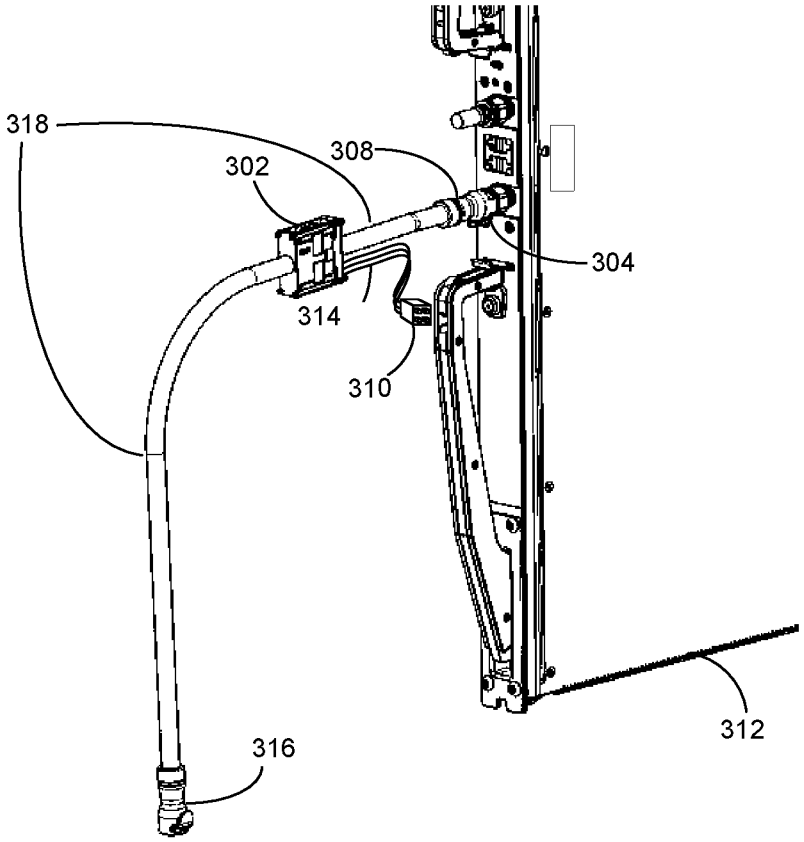
FIG. 3A illustrates an exemplary microaxial booster pump integrated into an external tray hose assembly and attached to a server tray, according to one aspect of the present application.

FIG. 3A illustrates the microaxial booster pump integrated into an external tray hose assembly and attached to a server tray, according to one aspect of the present application. In the example shown in FIG. 3A, a hot-swappable microaxial booster pump 302 is coupled to a plug 308 attached to a server residing in a server tray 312. Booster pump 302 can be powered via a connector 310 that plugs into the server, server tray 312, or another location in server rack, e.g., a rack manifold, or another power source designed to provide power and control for booster pump 302. External tray hose 318 can include a first fluid coupler 304 that can be plugged into the front of the server along with booster pump cable connections. The other end of external tray hose 318 can include a connection or a second fluid coupler 316 that can be attached to a fluid supply channel 321, e.g., a rack manifold.

Connector 310 can couple to the front of server tray to receive power and control signal from a power and control source. Alternatively, the booster pump wire connections with connector 310 can be at the rack manifold when the rack has a manifold integrated to control each booster pump. A variety of traditional connections are supported which can include a power connection, ground connection, tachometer, Pulse Width Modulation (PWM) module, etc.

Figure 3B:
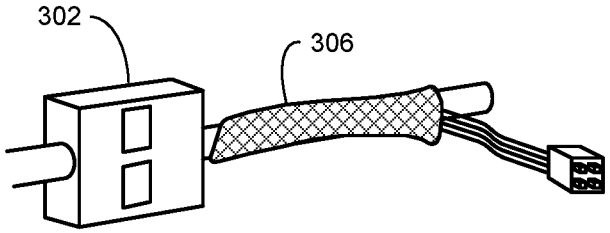
FIG. 3B illustrates an exemplary microaxial booster pump integrated into an external tray hose assembly with a protective sleeve, according to one aspect of the present application.

External tray hose 318, which can be made of flexible tubing, can have an outside diameter of approximately half an inch. Other host sizes can also be used. A first fluid coupler 304 can be connected at the front of the server and second fluid coupler 316 can be connected to a fluid supply channel 321, e.g., a rack manifold. FIG. 3B illustrates how wirings 314 can be in a protective sleeve 306 that can be joined and secured to the hose to prevent damage. In one embodiment, protective sleeve 306 can be a mesh tube or a heat-shrink tube. Other materials can also be used.

Figure 3C:
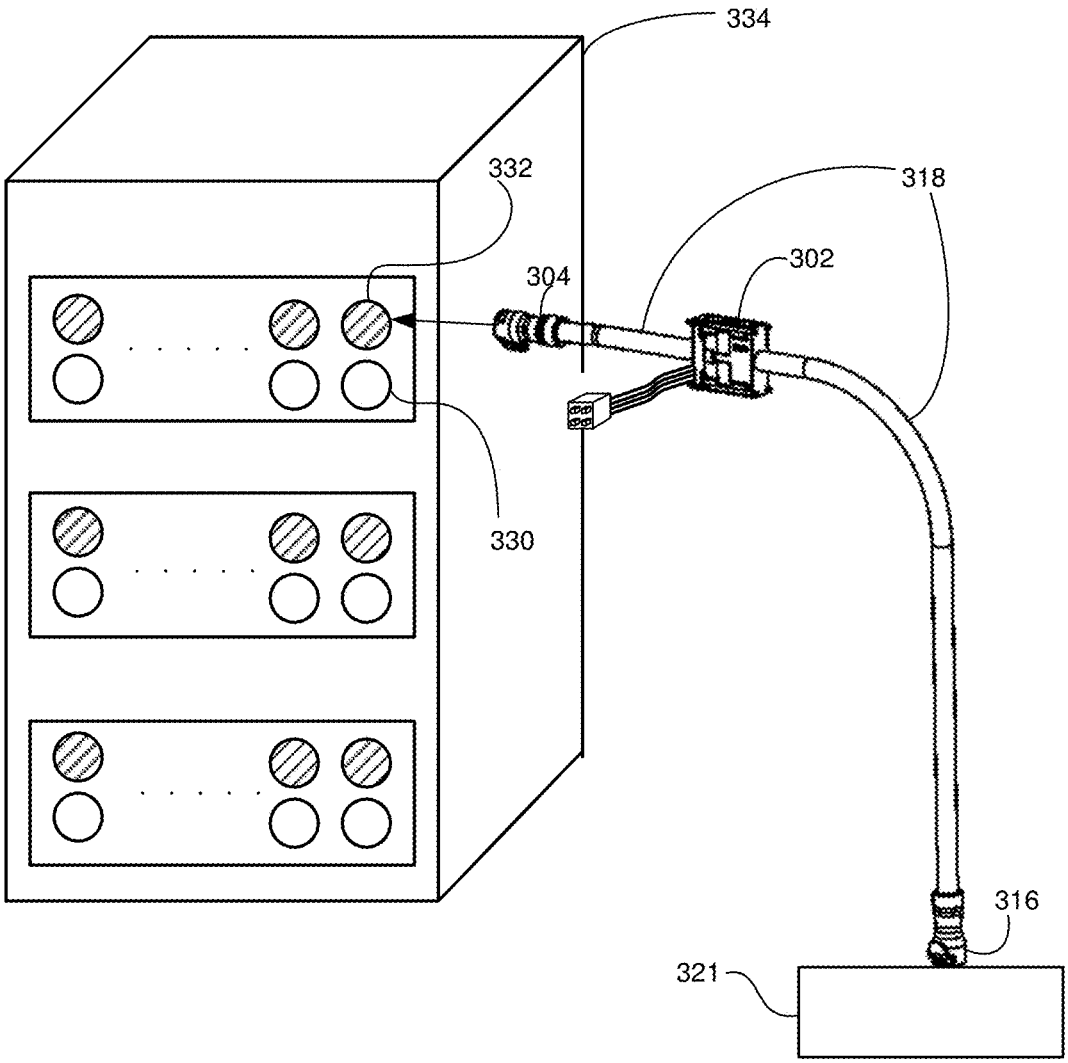
FIG. 3C illustrates an exemplary microaxial booster pump integrated into an external tray hose assembly and connected to a rack of servers, according to one aspect of the present application.

FIG. 3C illustrates the microaxial booster pump integrated into an external tray hose assembly and connected to a rack of servers, according to one aspect of the present application. In this example, external tray hose assembly (jointly 318, 304, 316) can be coupled to a rack of servers 334 with hose connections. In general, a server in rack 334 can have two hose connections, i.e., a supply coupler 332 and a return coupler 330. Fluid coupler 304 can be coupled to supply coupler 332 to supply fluid into the fluid network for cooling a computing device on the server tray within server rack 334.

Figure 4:
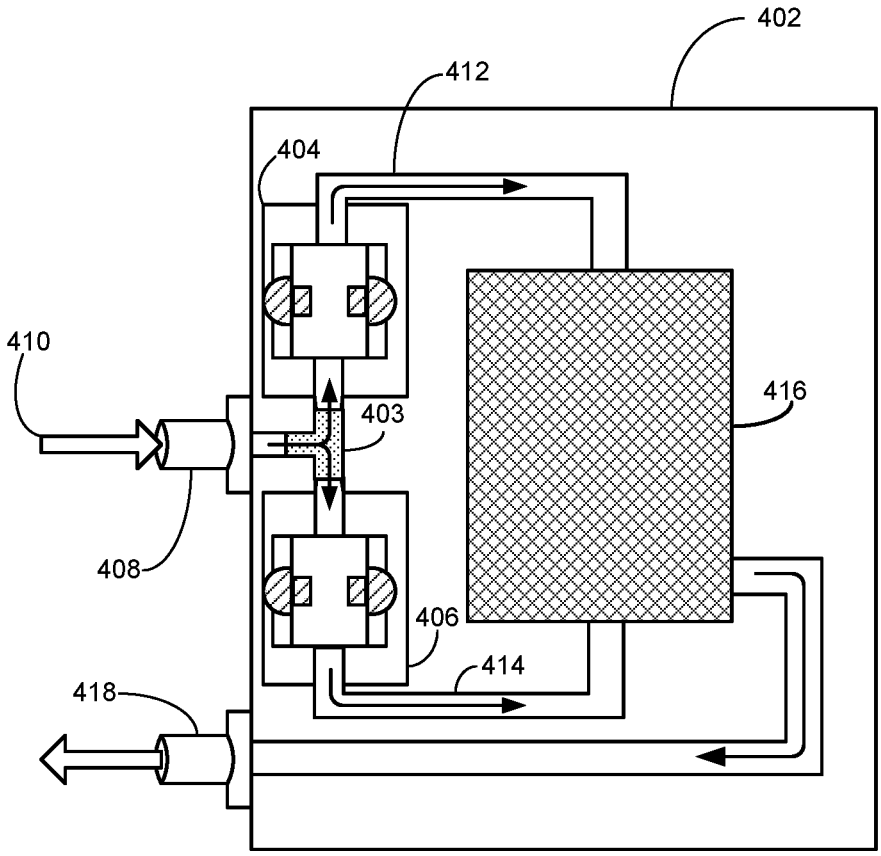
FIG. 4 illustrates an exemplary microaxial booster pump mounted within a server tray, according to one aspect of the present application.

FIG. 4 illustrates a microaxial booster pump mounted within a server tray, according to one aspect of the present application. The example shown in FIG. 4, depicts another use case for the microaxial booster pump. The booster pump can be mounted within a server tray 402, which means that the booster pump is mounted internal to server tray 402. The booster pump occupies a small footprint within server tray 402 and can provide the desired flow rate to the high impedance server. For example, the microaxial booster pump can occupy approximately 2.09 $in^3$ and can provide a power density (i.e., pump power consumption divided by pump volume) of approximately 0.697 $W/in^3$, Booster pump can support both an open-loop liquid-cooled solution and/or a closed loop liquid-cooled solution. Furthermore, the compact nature of the booster pump can facilitate its use in a space-constrained environment. In other words, the microaxial booster pump can optionally be mounted internal to server tray.

In one example, two or more microaxial booster pumps mounted within the server tray may be coupled in series or in parallel to allow adjustment of pump pressure and/or flow specifications. For example, booster pumps may be arranged in parallel to increase flow rate without increasing pressure drop or the pumps may be operated in series to increase both pressure drop and flow rate. For both series and parallel operations, the pumps may be arranged to rotate their respective impellers in opposite directions to reduce the swirl effects of the flow upstream of the pumps.

In one aspect, a compound pump may be provided, which can include two booster pumps in series, in which the fluid outlet of a first pump is connected to a fluid inlet of a second pump. Such a series connection of two booster pumps can increase the pressure associated with a single pump. The impellers of each pump may be configured to rotate in opposite directions with respect to one another. Such a configuration can enable a downstream impeller to mitigate the rotation of the coolant fluid caused by the upstream impeller, and hence can improve the efficiency of the compound pump. In a further arrangement of pumps, shown in FIG. 4, fluid inlet of each pump in a compound pump, which includes two pumps 404 and 406 connected in parallel, can be interconnected by a T-coupler 403 and jointly connected to a fluid inlet 408 (with arrow 410 indicating the direction of fluid flow). The fluid outlets of each pump can be connected to two fluid inlets of a server 416. The outgoing coolant fluid from server 416 can be guided to outlet 418. In this arrangement, pumps 404 and 406 are connected in parallel and can increase fluid flow rate. Further, such a parallel arrangement can provide parallel fluid flow paths 412 and 414 with a split tubing configuration. The split tubing configuration can facilitate a balanced fluid flow path towards server 416.

In one aspect, multiple pumps may be packaged in a small form factor (SFF) hard drive enclosure having approximately 15 mm in height. Such a packaging can provide hot swap ability of the pump package. Within the pump packaging, different fittings such as T-couplers can link the pumps to provide parallel or series flow paths, as may be desired for performance and resiliency.

Figure 5A:
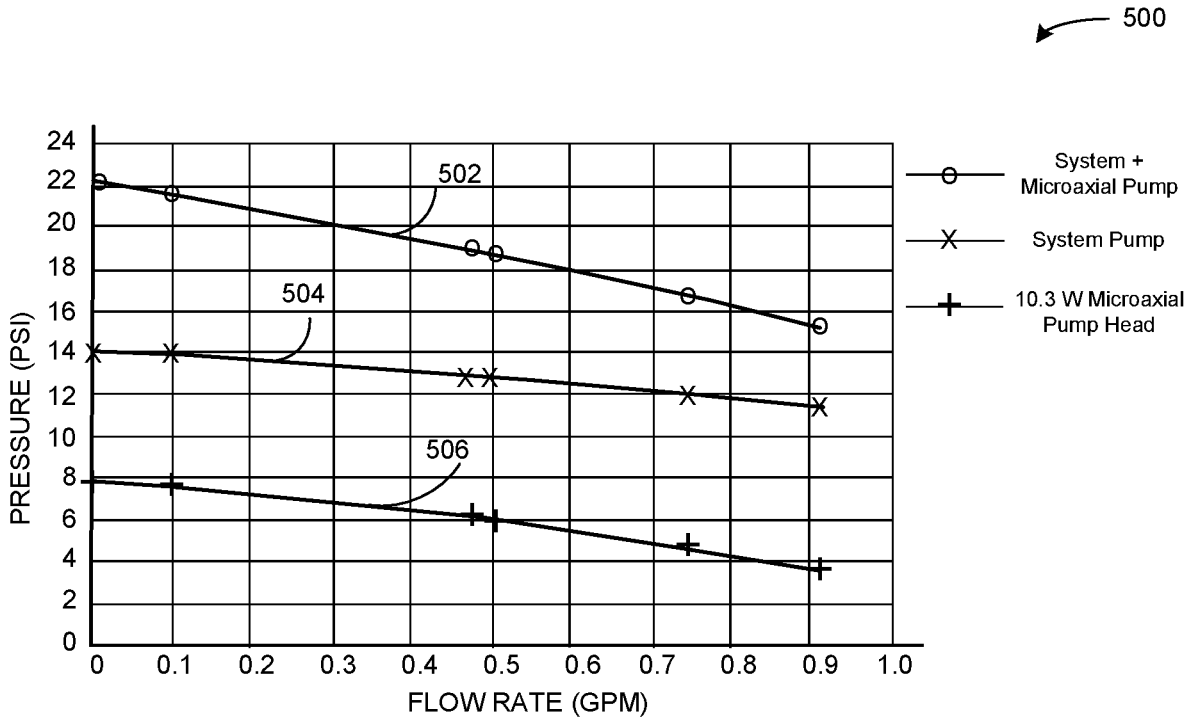
FIG. 5A shows a graph illustrating fluid pressure versus fluid flow rate curves for a system with and without a microaxial booster pump, according to one aspect of the present application.

FIG. 5A shows a graph including fluid pressure versus fluid flow rate curves for a system with and without a microaxial booster pump, according to one aspect of the present application. The performance of the microaxial booster pump in a booster capacity can be measured with an example setup which can include a CDU or helper pump in series with the microaxial booster pump. The role of the helper pump is similar to the role of a CDU in a cluster or a server rack. In the example shown in FIG. 5A, graph 500 shows a plot of pressure in pounds per square inch (psi) versus flow rate in gallons per minute (gpm). Curve 504 indicates the pressure vs flow rate values when the CDU system is used without the microaxial booster pump and includes just the CDU system pump. Curve 506 indicates the pressure vs flow rate values with a 10.3 W microaxial booster pump, and curve 502 indicates the pressure vs flow rate values when the CDU system includes a microaxial pump as a booster pump. Since the helper pump and the microaxial booster pump are operated in series, their individual heads are additive which is shown in FIG. 5A, i.e., adding corresponding values of curves 504 and 506 results in curve 502. The example shown in FIG. 5A indicates that the microaxial booster pump can be effectively applied as a booster pump in a CDU system.

In one example use case, the microaxial booster pump can be used in a stand-alone rack that can include two chassis (e.g., with eight servers per chassis), an in-rack CDU, rack manifolds (which comprise fluid supply channels and/or fluid exhaust channels) for fluid distribution, rectifiers for power conversion, switches, etc. The rack can support tubing for supply and exhaust fluid tubes that connect each server to the rack manifolds, which in turn can be connected to the in-rack CDU. Such a fluid distribution arrangement can make it easy to replace a regular fluid supply tube with a hot-swappable pump and tube as shown in FIG. 3B. When a hot-swappable pump is deployed on each of the available servers in the stand-alone rack or cabinet, the microaxial booster pumps can boost the performance of the CDU pump. Without the microaxial booster pumps running, the flow rate may be low, e.g., approximately 16.7 gpm. With the microaxial booster pumps running at approximately 16,700 rpm, the flow rate can increase, e.g., can be approximately 18 gpm, which results in a boost of about 1.3 gpm for the CDU when compared to a system with no booster pumps. Therefore, the microaxial booster pumps can in effect provide a flow rate boost and lower the system impedance that the CDU pump perceives, e.g., can result in approximately a 7.7% boost in flow rate for the CDU pump.

In another example use case, the microaxial booster pump can be used to deploy servers of mixed pressure drops (impedances) in a single chassis. In general, each slot in a chassis can accommodate one server. For example, a chassis with eight servers can include eight vertical slots with each slot accommodating a single server. In this case, it can be assumed that a server with a pressure drop higher than, e.g., larger by 121%, a nominal server (referred to as a 100% server) can be placed in a leftmost slot 1 and the rightmost slot 8 of a chassis that can house eight servers (or vertical blades). When a microaxial booster pump is included with a high impedance server, e.g., with 121% pressure drop when compared to a nominal server, the booster pump can lower the effective impedance of this server. Therefore, the inclusion of a microaxial booster pump can make a high impedance or a 121% server operate like a nominal or a 100% server by lowering the impedance of the 121% server.

In current systems, it is often desired to deploy servers with slightly higher impedances in a chassis, e.g., heterogeneous computing systems can include CPU and GPU servers mixed in a single chassis. Existing liquid-cooled solutions can be poorly suited to such heterogeneous computing systems. This is because the CDU can unevenly distribute the fluid flow across the different servers and to even out the fluid distribution across the servers the current systems raise the impedance of all the other servers, thereby increasing the impact on the CDU.

Figure 5B:
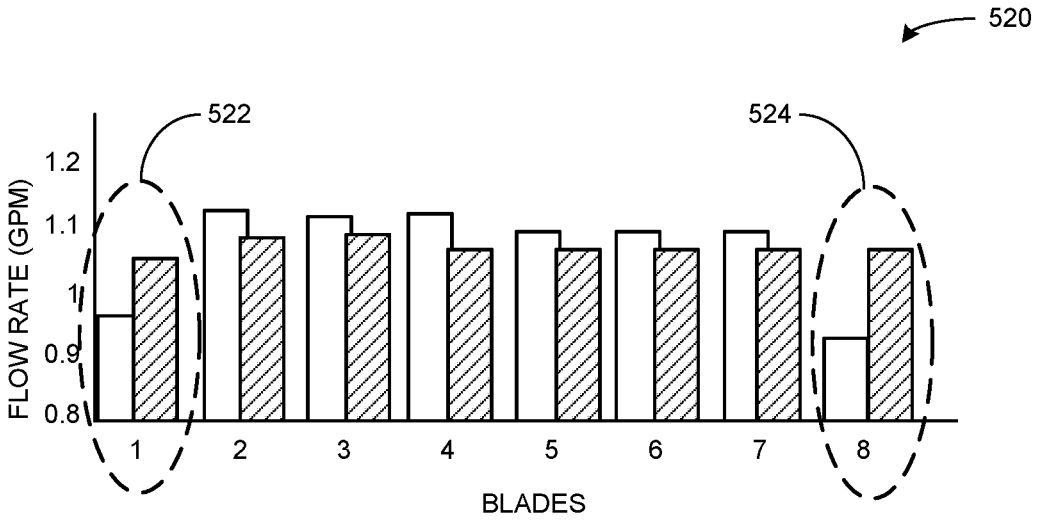
FIG. 5B shows a bar graph to illustrate how the microaxial booster pump can be used to deploy servers in a single chassis with mixed fluid pressure drops, according to one aspect of the present application.

FIG. 5B shows a bar graph to illustrate how the microaxial booster pump can be used to deploy servers in a single chassis with mixed fluid pressure drops, according to one aspect of the present application. For example, assume that a server with a pressure drop of about 150% higher than a nominal server (referred to as a 100% server) is placed in a leftmost slot 1 and the rightmost slot 8 of a chassis that houses eight servers (or vertical blades). In graph 520, the white bars indicate that without microaxial booster pumps deployed on servers in slot 1 and slot 8 in an eight-server chassis the fluid flow is unevenly distributed across the eight servers in the chassis. The patterned bars (i.e., with slanting line pattern) indicate that by deploying microaxial pumps on servers 1 and 8 the fluid flow distribution across all eight servers in the chassis can be approximately even or balanced. The patterned bars shown in 522 and 524 indicate how the deployment of microaxial booster pump can boost the flow on servers one and eight and reduce the burden on the CDU.

Adding a booster pump to an external hose assembly that is attachable to a server tray and a rack manifold (or a fluid supply channel) via fluid quick disconnects (or a mechanism that can reduce or eliminate fluid loss during a servicing event) can enable increased flow and performance, with no additional space used on a data center floor. Further, the microaxial booster pump can enable mixing of different trays with different pressure drops in a given cassis, and at a rack scale. The increase in performance provided by the booster pump can enable the use of PGW instead of treated water-based fluid. The hose-mounted pump can be easily serviceable and replaceable. Due to the compact nature of the booster pump, it can have varied number of applications in a space constrained environment. For example, the booster pump can be mounted within a server tray metal sheet volume to boost the fluid flow and pressure.

Figure 6:
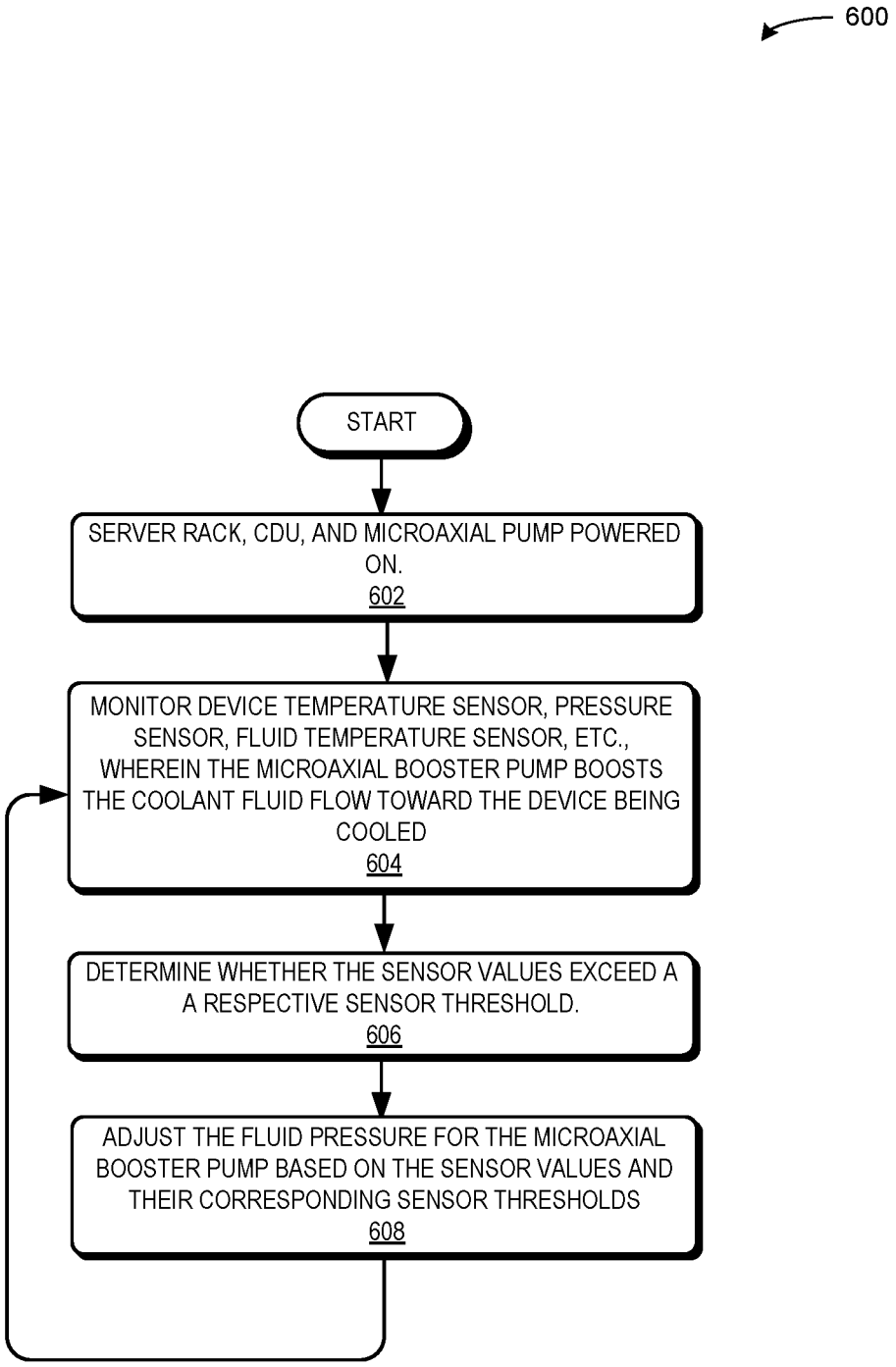
FIG. 6 presents a flowchart illustrating an exemplary process for controlling the fluid flow rate of the microaxial booster pump, according to one aspect of the present application.

FIG. 6 presents a flowchart illustrating an example process for controlling the fluid flow rate of the microaxial booster pump, according to one aspect of the present application. Referring to flowchart 600 in FIG. 6, during operation, i.e., when a server rack, CDU, and microaxial booster pump are powered on (operation 602), the system can monitor a number of servers deployed in the server rack (operation 604). For example, the server rack can include fluid pressure sensors, device temperature sensors, fluid temperature sensors, etc. The microaxial booster pump can be coupled to a server and provides the coolant fluid thereto. In some situations, the performance of the microaxial booster pump may be controlled to adjust the pressure of the fluid flow that is being driven from the rest of the fluid network. For example, in one aspect a control module which can include dedicated hardware and/or software and reside in a server or the server rack may control the behavior of a respective microaxial booster pump. To control the behavior of the microaxial booster pump, this control module can be configured to monitor a number of sensors.

In one embodiment, the rack level control module may include a monitor circuitry to monitor the pressure flow sensors and may determine whether the sensor values exceed a sensor threshold value (operation 606). Accordingly, the system can adjust the fluid pressure of the microaxial booster pump (operation 608). For example, the control module within a rack manager may monitor the pressure flow sensors and analyze their values. Based on the analysis the control module may speed-up or slow down the microaxial booster pump. For example, in a server chassis including eight servers, a server in the first slot can be a high impedance server and a microaxial booster pump connected to this server can boost the fluid flow towards the computing device in the first slot. When the control module at the server level identifies, based on the temperature sensors, that the temperature of a respective server has reached the normal range, the control module may slow down the corresponding microaxial booster pump.

In one aspect, the temperature sensors and the pressure sensors can be located at the server level instead of at the rack level. Correspondingly, the speed of the microaxial booster pump can be controlled by a server level control module based on the device temperature sensors (or pressure sensors) located at the server level.

Computer System

Figure 7:
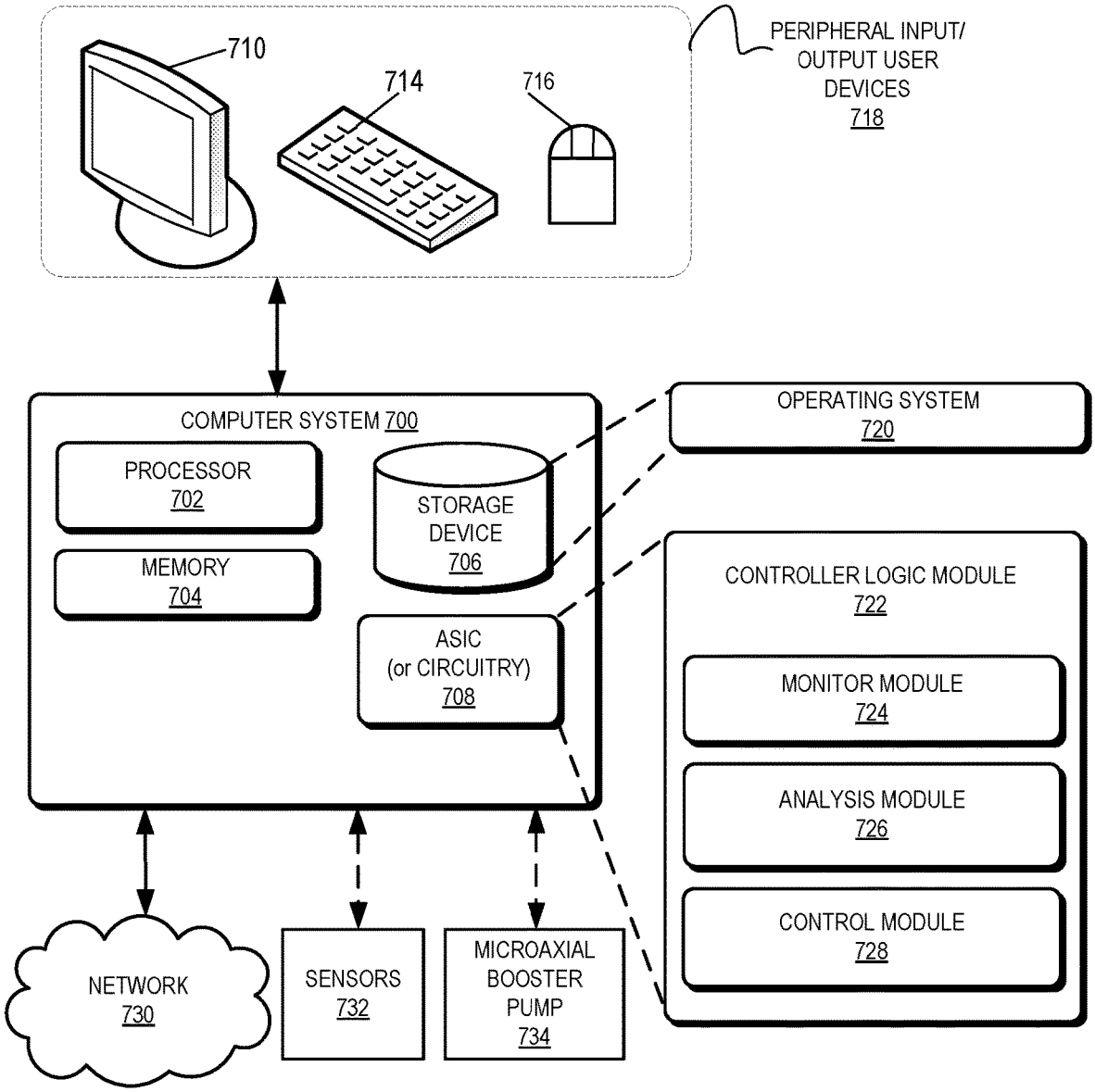
FIG. 7 illustrates an exemplary computer system that facilitates controlling of the fluid flow rate of the microaxial booster pump, according to one aspect of the present application.

FIG. 7 illustrates an example computer system that facilitates the controlling the fluid flow rate of the microaxial booster pump, according to one aspect of the present application. In this example, computer system 700 can include a processor 702, a memory 704, a storage device 706. Computer system 700 can be coupled to peripheral input/output (I/O) user devices 718, e.g., a display device 710, a keyboard 714, and a pointing device 716. Storage device 706 can store instructions for an operating system 720. Computer system 700 can be coupled via one or more network interfaces to a network 730, a set of sensors 732, and one or more microaxial booster pumps 734. Computer system 700 can be at rack level or at a server level in a rack.

Computer system 700 can be equipped with an ASIC or circuitry 708 which can include a controller logic module 722 to perform methods and/or processes described in this disclosure. Controller logic module 722 can implement the process shown in FIG. 6 and can include a monitor module 724, an analysis module 726, and a module 728. Controller logic module 722 can include one or more hardware components and/or software components (i.e., software components that include instructions executable by a processor to perform processes described in this application). A respective module can also include dedicated circuitry.

Monitor module 722 can monitor information or telemetry data corresponding to one or more sensors 732 which can include fluid pressure sensors, device temperature sensors, fluid temperature sensors, etc. Analysis module 726 can analyze the monitored information about sensors 732 and determine whether the sensor values exceed a sensor threshold. Based on this analysis, control module 728 can communicate with microaxial booster pump 734 to control or adjust the speed of microaxial booster pump 734.

One aspect described in this application can provide an apparatus for cooling a computing device. The apparatus can include a booster pump integrated into an external tray hose, the booster pump to boost fluid flow and fluid pressure of coolant fluid pumped toward a computing device on a server tray. The booster pump includes a stator mounted around booster pump housing with a bore. The stator includes one or more C-shaped lamination stacks for supporting coil windings. Energized coil windings generate a varying magnetic field that rotates an impeller within the housing bore to pump fluid along the housing bore A monitor logic to monitor a set of sensors to obtain information about one or more of fluid temperature, fluid pressure, and device temperature; and a control logic to adjust performance of the booster pump based on the information obtained from the set of sensors.

In a variation on this aspect, a first end of the external tray hose assembly is coupled at the server tray via a first fluid coupler. A second end of the external tray hose is coupled to a fluid supply channel via a second fluid coupler. The first fluid coupler is attached to the first end of the external tray hose. The second fluid coupler is attached to the second end of the external tray hose.

In a variation on this aspect, the booster pump is electrically coupled to a power and a control source, the power source and the control source providing power and control to the booster pump.

In a variation on this aspect, the external tray hose can include a swappable tube with a mechanism to decrease repair and/or replacement time in an event of failure of the booster pump.

In a further variation on this aspect, the apparatus can further include: a coolant distribution unit which includes a coolant distribution unit pump to pump the coolant fluid toward the computing device on the server tray; and the booster pump to boost fluid flow and fluid pressure of the coolant fluid pumped out by the coolant distribution unit pump.

In a further variation, the microaxial booster can be attached to a server in a chassis to ensure a flow that matches with flows associated with other servers in the chassis, wherein the server in the chassis has a different fluid pressure drop when compared to the other servers in the chassis.

In a further variation, the apparatus can further include an analysis logic to determine, based on the information obtained from the set of sensors, whether fluid pressure of the booster pump is to be adjusted; and the control logic to adjust, in response to determining that the fluid pressure of the booster pump is to be adjusted, the fluid pressure of the booster pump.

In another aspect, the apparatus can include a booster pump mounted within a server tray, the booster pump to boost fluid flow and fluid pressure of coolant fluid pumped toward a computing device on a server tray. The booster pump includes a stator mounted around booster pump housing with a bore. The stator includes one or more C-shaped lamination stacks for supporting coil windings. Energized coil windings generate a varying magnetic field that rotates an impeller within the housing bore to pump fluid along the housing bore. A monitor logic monitors a set of sensors to obtain information about one or more of fluid temperature, fluid pressure, and device temperature. A control logic to adjust performance of the booster pump based on the information obtained from the set of sensors.

In a variation of this aspect, the booster pump can be mounted within the server tray and be coupled to another pump on the server tray to pump the coolant fluid serially towards the computing device.

In a variation of this aspect, the booster pump mounted within the server tray is coupled to another pump on the server tray to pump coolant fluid in parallel towards the computing device.

One aspect described in this application can provide a system and method for boosting fluid flow and for adjusting performance of the booster pump. During operation, the system can receive, at a booster pump integrated into an external tray hose, a coolant fluid from a coolant distribution unit, wherein the booster pump comprises a stator mounted around booster pump housing with a bore, wherein the stator includes one or more C-shaped lamination stacks for supporting coil windings, and wherein energized coil windings generate a varying magnetic field that rotates an impeller within the housing bore to pump fluid along the housing bore. The system can boost fluid flow and fluid pressure of the coolant fluid pumped toward a computing device that is to be cooled on a server tray; and adjust performance of the booster pump based on the information associated with the set of sensors, wherein the information includes one or more of fluid temperature, fluid pressure, and device temperature.

The methods and processes described in the detailed description section can be embodied as code and/or data, which can be stored in a computer-readable storage medium as described above. When a computer system reads and executes the code and/or data stored on the computer-readable storage medium, the computer system performs the methods and processes embodied as data structures and code and stored within the computer-readable storage medium.

Furthermore, the methods and processes described above can be included in hardware modules or apparatus. The hardware modules or apparatus can include, but are not limited to, ASIC chips, field-programmable gate arrays (FPGAs), dedicated or shared processors that execute a particular software module or a piece of code at a particular time, and other programmable-logic devices now known or later developed. When the hardware modules or apparatus are activated, they perform the methods and processes included within them.

The foregoing descriptions of aspects have been presented for purposes of illustration and description. They are not intended to be exhaustive or to limit the scope of this disclosure to the forms disclosed. Accordingly, many modifications and variations will be apparent to practitioners skilled in the art.

What is claimed is:

1. An apparatus, comprising:

a booster pump integrated into an external tray hose, the booster pump to boost fluid flow and fluid pressure of coolant fluid pumped toward a computing device on a server tray, wherein the external tray hose comprises a first hose portion comprising a first end of the external tray hose and a second hose portion comprising a second end of the external tray hose, wherein the booster pump is integrated into the external tray hose between the first and second hose portions, wherein the first end is configured to be removably coupled to a supply coupler of a server tray and the second end is configured to be removably coupled to a fluid supply channel of a rack that houses the server tray, wherein the booster pump comprises a stator mounted on a booster pump housing with a bore, wherein the stator includes one or more C-shaped lamination stacks for supporting coil windings, and wherein energized coil windings generate a varying magnetic field that rotates an impeller within the housing bore to pump fluid along the housing bore;

a monitor module to monitor a set of sensors to obtain information about one or more of fluid temperature, fluid pressure, and computing device temperature; and a control module to adjust performance of the booster pump based on the information obtained from the set of sensors.

2. The apparatus of claim 1, wherein the booster pump is electrically coupled to a power source and the control module, the power source providing power to the booster pump.

3. The apparatus of claim 1, wherein the external tray hose includes a swappable tube with a self-sealing quick disconnect fluid coupler, or a combination of a valve and a fluid coupler, at each of the first end and the second end.

4. The apparatus of claim 1, further comprising:

a coolant distribution unit including a coolant distribution unit pump to pump the coolant fluid toward the computing device on the server tray;

wherein the booster pump is to boost fluid flow and fluid pressure of the coolant fluid pumped out by the coolant distribution unit pump.

5. The apparatus of claim 1, wherein the booster pump is attached to a server in a chassis to ensure a flow that matches with flows associated with other servers in the chassis; and wherein the server in the chassis has a different fluid pressure drop with respect to the other servers in the chassis.

6. The apparatus of claim 1, further comprising:

an analysis module to determine, based on the information obtained from the set of sensors, whether fluid pressure of the booster pump is to be adjusted; and the control module to adjust, in response to determining that the fluid pressure of the booster pump is to be adjusted, the fluid pressure of the booster pump.

7. A method, comprising:

receiving, at a booster pump integrated into an external tray hose, a coolant fluid from a coolant distribution unit, wherein the external tray hose comprises a first hose portion comprising a first end of the external tray hose and a second hose portion comprising a second end of the external tray hose, wherein the booster pump is integrated into the external tray hose between the first and second hose portions, wherein the first end is configured to be removably coupled to a supply coupler of a server tray and the second end is configured to be removably coupled to a fluid supply channel of a rack that houses the server tray, wherein the booster pump comprises a stator mounted around booster pump housing with a bore, wherein the stator includes one or more C-shaped lamination stacks for supporting coil windings, and wherein energized coil windings generate a varying magnetic field that rotates an impeller within the housing bore to pump fluid along the housing bore;

boosting, by the booster pump, fluid flow and fluid pressure of the coolant fluid pumped toward a computing device that is to be cooled on a server tray;

monitoring, by a set of sensors, one or more of fluid temperature, fluid pressure, and computing device temperature; and adjusting performance of the booster pump based on information output by the set of sensors, wherein the information is indicative of the monitored one or more of fluid temperature, fluid pressure, and device temperature.

8. The method of claim 7, wherein the booster pump mounted on the server tray is coupled in series to another pump on the server tray to pump the coolant fluid serially towards the computing device.

9. The method of claim 7, wherein the booster pump mounted on the server tray is coupled in parallel to another pump on the server tray to pump coolant fluid towards the computing device.

10. The method of claim 7, wherein the external tray hose includes a swappable tube with a self-sealing quick disconnect fluid coupler, or a combination of a valve and a fluid coupler, at each of the first end and the second end.

11. The method of claim 7, wherein the booster pump is attached to a server in a server chassis to ensure a flow that matches with flows associated with other servers in the server chassis, wherein the server in the server chassis has a different fluid pressure drop when compared to the other servers in the server chassis.

12. The method of claim 7, wherein adjusting performance of the booster pump based on the information associated with the set of sensors further comprises:

reducing speed of the booster pump.

13. The method of claim 7, wherein adjusting performance of the booster pump based on the information associated with the set of sensors further comprises:

increasing speed of the booster pump.

14. The method of claim 7, further comprising:

boosting, by the booster pump, fluid flow and fluid pressure of the coolant fluid pumped out by a coolant distribution unit pump, wherein the coolant distribution unit includes the coolant distribution unit pump to pump the coolant fluid toward the computing device on the server tray.

* * * * *